US009841696B2

(12) United States Patent
Gan et al.

(10) Patent No.: US 9,841,696 B2
(45) Date of Patent: Dec. 12, 2017

(54) IMAGE FORMING APPARATUS AND CLEANING METHOD

(71) Applicant: FUJI XEROX CO., LTD., Tokyo (JP)

(72) Inventors: Taijyu Gan, Kanagawa (JP); Toshihiko Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/216,319

(22) Filed: Jul. 21, 2016

(65) Prior Publication Data

US 2017/0255131 A1 Sep. 7, 2017

(30) Foreign Application Priority Data

Mar. 7, 2016 (JP) ..... 2016-043403

(51) Int. Cl.

| | |
|---|---|
| ***G03G 15/10*** | (2006.01) |
| ***G03G 13/10*** | (2006.01) |
| ***G03G 15/11*** | (2006.01) |
| ***G03G 13/11*** | (2006.01) |

(52) U.S. Cl.

CPC ..... *G03G 13/10* (2013.01); *G03G 13/11* (2013.01); *G03G 15/10* (2013.01); *G03G 15/11* (2013.01)

(58) Field of Classification Search

CPC ..... G03G 15/10; G03G 15/11; G03G 13/10; G03G 13/11; G03G 21/0088; G03G 2215/0658; G03G 2221/0084

USPC ..... 399/237, 239, 249

See application file for complete search history.

(56) References Cited

U.S. PATENT DOCUMENTS 5,387,760 A * 2/1995 Miyazawa ..... G03G 15/101 399/239
6,512,907 B2 * 1/2003 Nishikawa ..... G03G 15/11 15/256.51
8,873,981 B2 * 10/2014 Fukumoto ..... G03G 15/0815 399/249

FOREIGN PATENT DOCUMENTS

JP 2005315946 A * 11/2005
JP 2005-338733 A 12/2005
JP 2007108201 A * 4/2007
JP 2011-170072 A 9/2011

* cited by examiner

*Primary Examiner* — Robert Beatty
(74) *Attorney, Agent, or Firm* — Oliff PLC

(57) ABSTRACT

Provided is an image forming apparatus including a first holding member that is rotated and holds a liquid developer including a volatile carrier liquid, a first cleaning member that is able to come into contact with or separated from the first holding member and cleans a surface of the first holding member by being in contact with the first holding member, a supplying device that supplies a volatile washing liquid to the first holding member at an upstream side of the first cleaning member in a rotation direction of the first holding member, and a switching mechanism that switches a first state in which the first cleaning member is in contact with the first holding member that is rotated to a second state in which the first cleaning member is separated from the first holding member that is rotated to apply the washing liquid to the first holding member.

14 Claims, 8 Drawing Sheets

IMAGE FORMING APPARATUS AND CLEANING METHOD

CROSS-REFERENCE TO RELATED APPLICATIONS

This application is based on and claims priority under 35 USC 119 from Japanese Patent Application No. 2016-043403 filed Mar. 7, 2016.

BACKGROUND

Technical Field

The present invention relates to an image forming apparatus and a cleaning method.

SUMMARY

According to an aspect of the invention, there is provided an image forming apparatus including:

a first holding member that is rotated and holds a liquid developer including a volatile carrier liquid;

a first cleaning member that is able to come into contact with or separated from the first holding member and cleans a surface of the first holding member by being in contact with the first holding member;

a supplying device that supplies a volatile washing liquid to the first holding member at an upstream side of the first cleaning member in a rotation direction of the first holding member; and a switching mechanism that switches a first state in which the washing liquid is supplied to the first holding member in a state in which the first cleaning member is in contact with the first holding member that is rotated to a second state in which the first cleaning member is separated from the first holding member that is rotated and the washing liquid is applied to the first holding member.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the image forming apparatus of the invention will be described with reference to drawings. Also, an arrow H illustrated in each drawing indicates an up and down direction (vertical direction) of the apparatus, and an arrow W indicates a width direction (horizontal direction) of the apparatus.

First Exemplary Embodiment

Entire Configuration of Image Forming Apparatus

Figure 1:
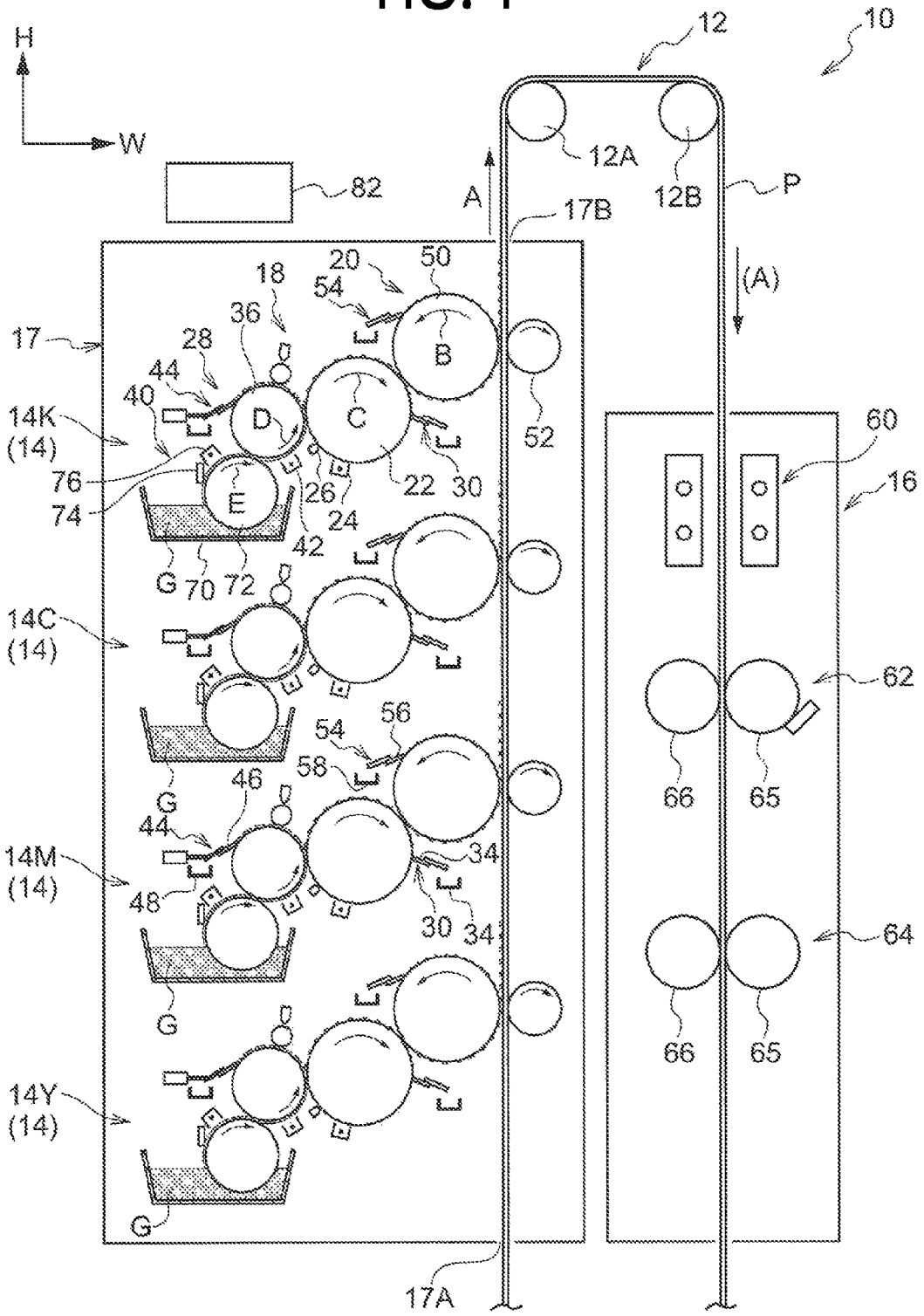
FIG. 1 is a configuration view illustrating an image forming apparatus according to a first exemplary embodiment of the invention.

In FIG. 1, an example of an image forming apparatus 10 of a first exemplary embodiment is illustrated. As illustrated in FIG. 1, the image forming apparatus 10 includes a transportation unit 12 which transports continuous form paper P as an example of a recording medium, an image forming section 14 which forms a toner image on the continuous form paper P, and a fixing device 16 which fixes the toner image to the continuous form paper P.

The transportation unit 12 has a function of transporting the continuous form paper P in an arrow A direction (transportation direction) at a predetermined transportation speed. Moreover, the transportation unit 12 winds the continuous form paper P, and includes a pair of transport rolls 12A and 12B which are disposed side by side in a width direction of the apparatus. The transport roll 12A is disposed on an upstream side of the transportation direction of the continuous form paper P with respect to the transport roll 12B. The continuous form paper P is transported from a lower side to an upper side of an up and down direction in the upstream side with respect to the transport roll 12A, and is transported from the upper side to the lower side of the up and down direction in a downstream side with respect to the transport roll 12B.

The image forming section 14 includes an image forming section 14Y which forms a toner image of a yellow color (Y), an image forming section 14M which forms a toner image of a magenta color (M), an image forming section 14C which forms a toner image of a cyan color (C), and an image forming section 14K which forms a toner image of a black color (K). In the image forming apparatus 10, as an example, the image forming sections 14Y, 14M, 14C, and 14K are disposed in this order from the upstream side in the transportation direction of the continuous form paper P.

The image forming sections 14Y, 14M, 14C, and 14K of each color are disposed inside a housing 17. In a lower wall of the housing 17, an opening 17A where the continuous form paper P transported by the transportation unit 12 is entered into the housing 17 is formed, and in a upper wall of the housing 17, an opening 17B, which exits the continuous form paper P entered into the housing 17 to the outside of the housing 17, is formed. The image forming sections 14Y, 14M, 14C, and 14K of each color are formed basically in the same manner except a liquid developer G to be used.

The image forming sections 14Y, 14M, 14C, and 14K of each color include, an image forming unit 18 for forming the toner image using the liquid developer G including toner and insulating liquid, and a transfer unit 20 for transferring a toner image formed by the image forming unit 18 to the continuous form paper P. In the exemplary embodiment, the continuous form paper P is transported to the upper side from the lower side in the up and down direction by the transportation unit 12, and the image forming sections 14Y, 14M, 14C, and 14K of each color are disposed side by side from the lower side toward the upper side in the up and down direction.

The image forming unit 18 includes an image holding member 22 which rotates in an arrow C direction and holds the toner image. Also, the image forming unit 18 includes sequentially a charging device 24 which charges the image holding member 22, an exposure device 26 which irradiates the image holding member 22 with exposing light and forms an electrostatic latent image, and a developing device 28 which develops the electrostatic latent image on the image holding member 22 as a toner image, from the upstream side of a rotation direction (arrow C direction) of the image holding member 22. Further, the image forming unit 18 includes a cleaning device 30 which cleans an outer peripheral surface of the image holding member 22, after the toner image is transferred to a transfer roll 50 to be described later from the image holding member 22. The cleaning device 30 includes a scraping blade 32 as an example of a cleaning member which scrapes the liquid developer G remaining on the outer peripheral surface of the image holding member 22 without being transferred to the transfer roll 50 from the image holding member 22, and a recovering member 34 which recovers the scraped liquid developer G.

The developing device 28 includes a developing roll 36, which rotates in an arrow D direction and develops an electrostatic latent image formed on the image holding member 22 using the liquid developer G, as an example of a holding member. In addition, the developing device 28 sequentially includes a supplying device 40, which supplies the liquid developer G to the developing roll 36, and a charging device 42, which charges toners included in the liquid developer G supplied to the developing roll 36, from the upstream side of a rotation direction (arrow D direction) of the developing roll 36. Further, the developing device 28 includes a cleaning device 44 which cleans an outer peripheral surface of the developing roll 36 after developing. The cleaning device 44 includes a scraping blade 46, which scrapes the liquid developer G remaining on the outer peripheral surface of the developing roll 36, as an example of the cleaning member, and a recovering member 48 which recovers the scraped liquid developer G.

The liquid developer G used for the exemplary embodiment is a liquid type developer in which toners (particles) are dispersed in volatile carrier liquid, and as carrier liquid, insulating liquid having volatility which is selected from, for example, vegetable oil, liquid paraffin oil, and silicone oil, is used. In addition, relating to the liquid developer G, as an example, an average particle diameter of the toner is 0.5 μm or more and 5 μm or less, and the toner (particles) in the carrier liquid is dispersed at a concentration of 15 wt % or more and 45 wt % or less.

The supplying device 40 includes a container 70 which is disposed on a lower side of the developing roll 36 and accommodates the liquid developer G, and a supplying roll 72 which pumps the liquid developer G from the container 70 and supplies the developer to the outer peripheral surface of the developing roll 36. The supplying roll 72 is rotated in an arrow E direction, and is moved in the same direction as that of the developing roll 36 at a position in contact with the developing roll 36. The supplying roll 72 includes plural concave portions (not illustrated) on the outer peripheral surface thereof, and the liquid developer G is held on the concave portions. In addition, the supplying device 40 includes a regulating blade 74 which adjusts a layer film of the liquid developer G attached to the supplying roll 72, and a charging device 76 which charges toners included in the liquid developer G attached to the supplying roll 72.

In the supplying device 40, the liquid developer G accommodated in the container 70 is pumped due to rotation of the supplying roll 72, and the layer film of the liquid developer G attached to the supplying roll 72 is regulated by the regulating blade 74. Further, the liquid developer G attached to the supplying roll 72 is supplied to the outer peripheral surface of the developing roll 36 by an electrical field formed between the supplying roll 72 and the developing roll 36.

In the developing device 28, the charging device 42 charges the toner included in the liquid developer G supplied to the outer peripheral surface of the developing roll 36, and an electrostatic latent image on the image holding member 22 is developed as a toner image by the liquid developer G of the outer peripheral surface of the developing roll 36. Also, in a case in which the electrostatic latent image is developed as the toner image using the liquid developer G, the carrier liquid is also moved to the image holding member 22.

The transfer unit 20 includes the transfer roll 50, which is disposed to face the image holding member 22 and rotated in the arrow B direction, on which the toner image on the image holding member 22 is transferred due to an electrical field formed between the image holding member 22 and the roll. In addition, the transfer unit 20 is disposed on an opposite side of the transfer roll 50 with the continuous form paper P pinched therebetween, and includes a backup roll 52 which transfers the toner image on the transfer roll 50 to the continuous form paper P due to the electrical field formed between the unit and the transfer roll 50. Further, the transfer unit 20 includes a cleaning device 54 which cleans the outer peripheral surface of the transfer roll 50 after transferring. The cleaning device 54 includes a scraping blade 56 which scrapes the liquid developer G remaining on the outer peripheral surface of the transfer roll 50 after transferring, and a recovering member 58 which recovers the scraped liquid developer G.

In the transfer unit 20, the toner image on the image holding member 22 is transferred to the transfer roll 50, and the toner image transferred to the transfer roll 50 is transferred to the continuous form paper P. In addition, in the same manner, the carrier liquid which is moved from the developing roll 36 to the image holding member 22, is also moved to the continuous form paper P through the transfer roll 50.

The fixing device 16 includes a heating portion 60 which heats the continuous form paper P, a carrier liquid removing portion 62 which removes the carrier liquid from the continuous form paper P, and a fixing portion 64 which fixes the toner image to the continuous form paper P. The carrier liquid removing portion 62 and the fixing portion 64 include a heating roll 65, and a pressure roll 66 which presses the continuous form paper P with the heating roll 65.

In the fixing device 16, the heating portion 60 heats the continuous form paper P, and the toner included in the liquid developer G on the continuous form paper P and the carrier liquid (oil) are dispersed, and therefore, an oil layer is formed on an upper layer of the toner. Further, the carrier liquid removing portion 62 removes the carrier liquid (oil), and the continuous form paper P is heated and pressed, and thus the toner image is fixed to the continuous form paper P by the fixing portion 64.

In the image forming apparatus 10 described above, the image holding member 22 of the image forming unit 18 of each color is rotated, and the charging device 24 charges the outer peripheral surface of the image holding member 22 with electricity. Next, the exposure device 26 exposes the outer peripheral surface of the image holding member 22, and the electrostatic latent image is formed on the outer peripheral surface of the image holding member 22. The electrostatic latent image is developed by the developing device 28 as a toner image. Further, the toner image formed on the rotated outer peripheral surface of the image holding member 22 is primarily transferred to the transfer roll 50. The toner image primarily transferred to the transfer roll 50 is transferred to the continuous form paper P being transported in the arrow A direction. Such a process is carried out in the image forming section 14 of each color, and the toner image in which colors are superimposed is formed on the continuous form paper P. Further, the fixing device 16 removes the carrier liquid (oil) of the transported continuous form paper P, and fixes the toner image to the continuous form paper P.

Main Configuration of Image Forming Apparatus

Next, an image forming apparatus of a first exemplary embodiment will be described with reference to FIG. 2 and FIG. 3.

Figure 2:
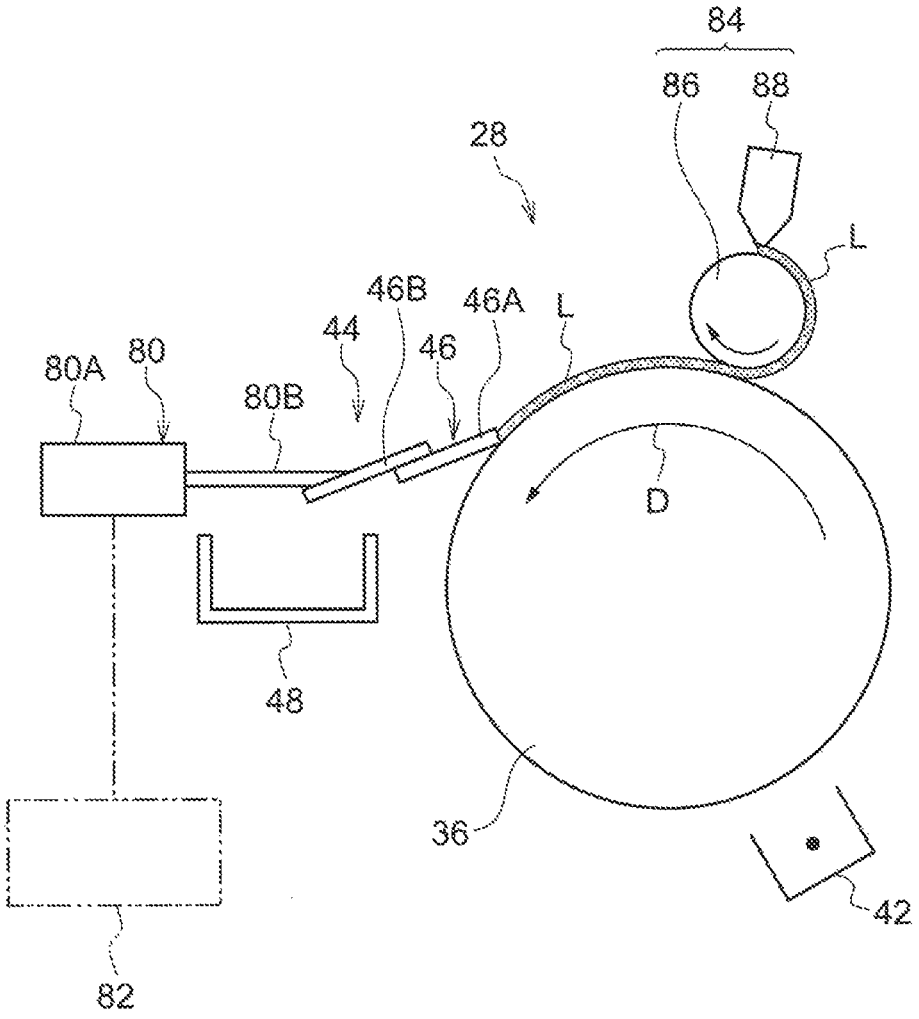
FIG. 2 is a configuration view illustrating a state in which a contact portion of a developing roll and a scraping blade used for the image forming apparatus illustrated in FIG. 1 is washed.

FIG. 2 illustrates, in a main configuration of the image forming apparatus 10 illustrated in FIG. 1, a state in which a contact portion of the developing roll 36 and the scraping blade 46 is washed with the washing liquid L. In addition, FIG. 3 illustrates, in a main configuration of the image forming apparatus illustrated in FIG. 1, a state of applying the washing liquid L to the developing roll 36.

Figure 3:
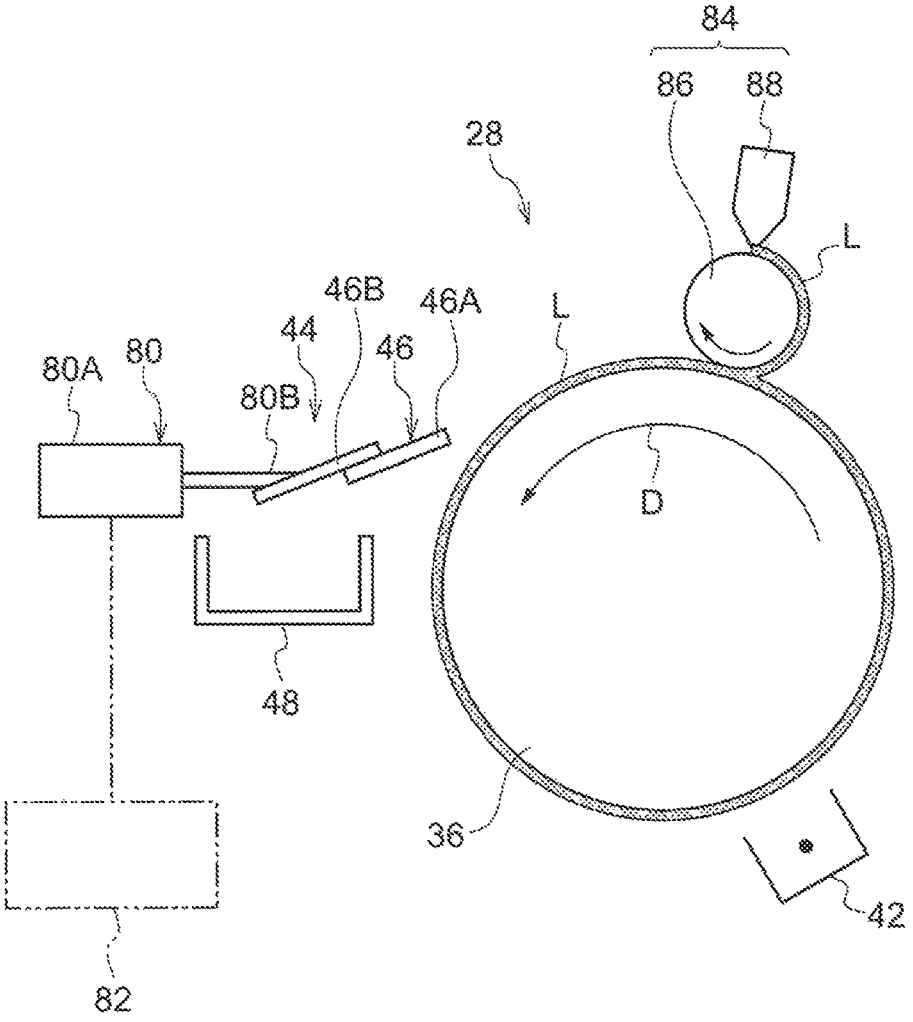
FIG. 3 is a view illustrating a state in which the scraping blade is separated from the developing roll used for the image forming apparatus illustrated in FIG. 1 and washing liquid is applied to the developing roll.

As illustrated in FIG. 2 and FIG. 3, the developing device 28 includes a contact and separation device 80 which allows the scraping blade 46 to be brought into contact with the outer peripheral surface of the developing roll 36 or to separate the scraping blade 46 from the outer peripheral surface of the developing roll 36. The scraping blade 46 includes a plate-shaped blade portion 46A which scrapes the liquid developer G remaining on the outer peripheral surface of the developing roll 36 in contact with the developing roll 36, and a supporting member 46B supporting the blade portion 46A. The blade portion 46A is disposed to be in contact with the developing roll 36 so that a front edge of the blade portion 46A is toward an upstream side of a rotation direction of the developing roll 36. The contact and separation device 80 includes, as an example, a hydraulic cylinder. More specifically, the contact and separation device 80 includes a cylinder main body portion 80A, and a rod 80B which moves forward and backward with respect to the cylinder main body portion 80A and an edge portion thereof is fixed to the supporting member 46B. When the rod 80B moves forward and backward with respect to the cylinder main body portion 80A, the scraping blade 46 is moved to a position of being in contact with the outer peripheral surface of the developing roll 36, and the scraping blade 46 is moved to a position of being separated from the outer peripheral surface of the developing roll 36. In the image forming apparatus 10 (refer to FIG. 1), a controller 82, which controls an operation of the contact and separation device 80, is provided. The controller 82 controls a rotational operation of the developing roll 36, a rotational operation of the image holding member 22, and a rotational operation of the transfer roll 50. The contact and separation device 80 and the controller 82 are an example of a switching mechanism. The controller 82 will be described later.

In addition, the developing device 28 includes a supplying device 84 which supplies the washing liquid L to the outer peripheral surface of the developing roll 36. The supplying device 84 includes, as an example, a supplying roll 86 which is in contact with the developing roll 36 and rotated at the same time and supplies the washing liquid L to the outer peripheral surface of the developing roll 36, and a nozzle 88 which ejects the washing liquid L to the supplying roll 86. The supplying device 84 is disposed at an upstream side of the scraping blade 46 in a rotation direction (arrow D direction) of the developing roll 36. In addition, the supplying device 84 is disposed at the downstream side further than a facing portion with the image holding member 22 (refer to FIG. 1) in a rotation direction (arrow D direction) of the developing roll 36. In the exemplary embodiment, the developing roll 36 is in contact with the image holding member 22, and is configured to rotate in the same direction at a contacting position with the image holding member 22 (refer to FIG. 1).

The washing liquid L is volatile washing liquid, and as an example, volatile carrier liquid including a two-component developer G is used. Moreover, the washing liquid L is not limited to the volatile carrier liquid, and for example, volatile organic solvent, or the like may be used.

The supplying roll 86 has a function of holding the washing liquid L ejected from the nozzle 88 and supplying the liquid to the outer peripheral surface of the developing roll 36. The supplying roll 86 is supported to be rotatable, and is rotated in the same direction as that of the contact portion of the developing roll 36. In the exemplary embodiment, the supplying roll 86 is configured to be rotated by following the rotation of the developing roll 36; however, the supplying roll 86 may be configured to be driven by being rotated.

As the supplying roll 86, for example, a sponge roll which impregnates and holds the washing liquid L, an anilox roll which includes plural concave portions in the outer peripheral surface and holds the washing liquid L in the concave portions, or the like is used. In the nozzle 88, a supplying tube (not illustrated) supplying the washing liquid L using a pump from a storage tank which is not illustrated is connected.

When the supplying device 84 supplies the washing liquid L to the outer peripheral surface of the developing roll 36 being rotated, the washing liquid L is supplied to a contact portion between the developing roll 36 and the scraping blade 46, and thus the washing liquid L causes the contact portion between the developing roll 36 and the scraping blade 46 to be washed (refer to FIG. 2).

The controller 82 controls an operation of the contact and separation device 80, and allows the scraping blade 46 to be in contact with the outer peripheral surface of the developing roll 36, or to separate the scraping blade 46 from the outer peripheral surface of the developing roll 36. As illustrated in FIG. 3, if the scraping blade 46 is separated from the outer peripheral surface of the developing roll 36, the washing liquid L is supplied to the outer peripheral surface of the developing roll 36 being rotated from the supplying device 84, and the washing liquid L is applied to the outer peripheral surface of the developing roll 36.

That is, the controller 82 has a function of switching a first state in which the washing liquid L is supplied to the developing roll 36 in a state in which the scraping blade 46 is in contact with the developing roll 36 which is being rotated, to a second state in which the scraping blade 46 is separated from the developing roll 36 which is being rotated, and then the washing liquid L is applied to the developing roll 36. In the exemplary embodiment, as an example, the controller 82 sets a state to be the first state after forming an image, and thus the washing liquid L causes the contact portion between the scraping blade 46 and the developing roll 36 to be washed. In addition, the controller switches the state to be the second state after the washing liquid L washes the contact portion between the scraping blade 46 and the developing roll 36. In the exemplary embodiment, "after washing" means a predetermined time has elapsed from starting washing. That is, the controller 82 switches the state to the second state, after a predetermined time elapses from starting washing. Moreover, "after washing" may mean that the developing roll 36 is rotated at the number of rotations which is predetermined. In addition, in the exemplary embodiment, as an example, after the first state when an image is formed, and the state is switched to the second state; however, the invention is not limited to such a configuration. For example, switching between the first state and the second state may be carried out before forming an image or during forming an image, and the state may be switched from the second state to the first state.

Action and Effect

Next, an action and effect of the image forming apparatus 10 of the exemplary embodiment will be described with reference to a cleaning method of the exemplary embodiment.

As illustrated in FIG. 2, as an example, the controller 82 rotates the developing roll 36 in the arrow D direction in a state in which the scraping blade 46 is in contact with the developing roll 36 after forming an image (after a series of an image forming process is finished). Accordingly, the washing liquid L is supplied from the supplying roll 86 of the supplying device 84 to the outer peripheral surface of the developing roll 36, and the washing liquid L is supplied to the contact portion between the developing roll 36 and the scraping blade 46 due to rotation of the developing roll 36. A state in which the washing liquid L is supplied to the developing roll 36 is the first state. Accordingly, the scraping blade 46 and the contact portion between the developing roll 36 and the scraping blade 46 are washed by the washing liquid L (first process).

As illustrated in FIG. 3, after the first state, that is, after a predetermined time has elapsed from starting washing, when the controller 82 operates the contact and separation device 80 in a state in which the developing roll 36 is rotated in the arrow D direction, the scraping blade 46 is separated from the developing roll 36. Accordingly, when the washing liquid L is supplied from the supplying roll 86 of the supplying device 84 to the outer peripheral surface of the developing roll 36, the washing liquid L is applied to the outer peripheral surface of the developing roll 36 (second process). The controller 82 stops rotation of the developing roll 36 in a state in which the scraping blade 46 is separated from the developing roll 36. A state in which the washing liquid L is applied to the outer peripheral surface of the developing roll 36 is the second state. Therefore, accumulating of the liquid developer G in the contact portion between the developing roll 36 and the scraping blade 46 is suppressed, and drying and fixing of the liquid developer G which is accumulated in the contact portion between the developing roll 36 and the scraping blade 46 is suppressed.

In the image forming apparatus 10, as compared to a configuration in which the cleaning member comes into contact with the holding member at the time of stopping rotation of a holding member, cleaning failure or an image quality defect due to drying and fixing of the liquid developer G accumulated in the contact portion between the developing roll 36 and the scraping blade 46 is suppressed.

Also, in the cleaning method using the above described image forming apparatus 10, as compared to the cleaning method in which the cleaning member comes into contact with the holding member at the time of stopping rotation of the holding member, cleaning failure or an image quality defect due to drying and fixing of the liquid developer G accumulated in the contact portion between the developing roll 36 and the scraping blade 46 is suppressed.

First Modification Example

In the image forming apparatus 10 described above, an example in which the supplying device 84 is provided to the developing roll 36 and the washing liquid L is supplied is described, but instead of the developing roll 36, the washing liquid L may be supplied by providing the supplying device to the image holding member 22 as an example of the holding member.

In the image forming apparatus 10 of a first modification example, it is not illustrated, but in the scraping blade 32 as an example of the cleaning member of the image holding member 22, the contact and separation device is provided as an example of the switching mechanism. In addition, the controller 82 as an example of the switching mechanism allows the scraping blade 32 to be brought into contact with the outer peripheral surface of the image holding member 22 by controlling operation of the contact and separation device, or to separate the scraping blade 32 from the outer peripheral surface of the image holding member 22. Further, as an example, the controller 82 switches the first state in which the washing liquid L is supplied to the image holding member 22 in a state in which the scraping blade 32 is in contact with the image holding member 22 which is being rotated after forming an image, to the second state in which the washing liquid L is applied to the image holding member 22 in which the scraping blade 32 is separated from the image holding member 22 which is being rotated. In the first state, the scraping blade 32 and a contact portion between the scraping blade 32 and the image holding member 22 are washed by the washing liquid L supplied to the image holding member 22, and the state is switched to the second state after the washing.

In the image forming apparatus 10 of the first modification example, as compared to a configuration in which the cleaning member comes into contact with the holding member at the time of stopping rotation of the holding member, cleaning failure or an image quality defect due to drying and fixing the liquid developer G, which is accumulated in the contact portion between the image holding member 22 and the scraping blade 32, is suppressed.

Second Modification Example

In the image forming apparatus 10 described above, an example in which the supplying device 84 is provided to the developing roll 36 and the washing liquid L is supplied is described, but instead of the developing roll 36, the washing liquid L may be supplied by providing the supplying device to the transfer roll 50 as an example of the holding member.

In the image forming apparatus 10 of the second modification example, it is not illustrated, but in the scraping blade 56 as an example of the cleaning member of the transfer roll 50, the contact and separation device as an example of the switching mechanism is provided. In addition, the controller 82 as an example of the switching mechanism allows the scraping blade 56 to be in contact with the outer peripheral surface of the transfer roll 50 by controlling an operation of the contact and separation device, or to separate the scraping blade 56 from the outer peripheral surface of the transfer roll 50. Further, as an example, the controller 82 switches the first state in which the washing liquid L is supplied to the transfer roll 50 in a state in which the scraping blade 56 is in contact with the transfer roll 50 which is being rotated after forming an image, to the second state in which the scraping blade 56 is separated from the transfer roll 50 which is being rotated after washing, and then the washing liquid L is applied to the transfer roll 50. In the first state, the scraping blade 56 and a contact portion between the scraping blade 56 and the transfer roll 50 are washed using the washing liquid L, and the state is switched to the second state after washing.

In the image forming apparatus 10 of the second modification example, as compared to a configuration in which the cleaning member comes into contact with the holding member at the time of stopping rotation of the holding member, cleaning failure or an image quality defect due to drying and fixing of the liquid developer G accumulated in a contact portion between the transfer roll 50 and the scraping blade 56 is suppressed.

Second Exemplary Embodiment

Next, with reference to FIG. 4 to FIG. 8, an image forming apparatus as a second exemplary embodiment of the invention will be described. Also, configuration parts the same as that of the first exemplary embodiment described before will be given the same numbers and description thereof will be omitted.

Configuration of Image Forming Apparatus

In FIG. 4 to FIG. 8, an image forming section 102 used for an image forming apparatus 100 is illustrated. Four image forming sections 102 are disposed in actual, and basically has a same configuration except the liquid developer G to be used, and therefore, one image forming section 102 is illustrated, and description of image forming sections of four colors will be omitted.

Figure 4:
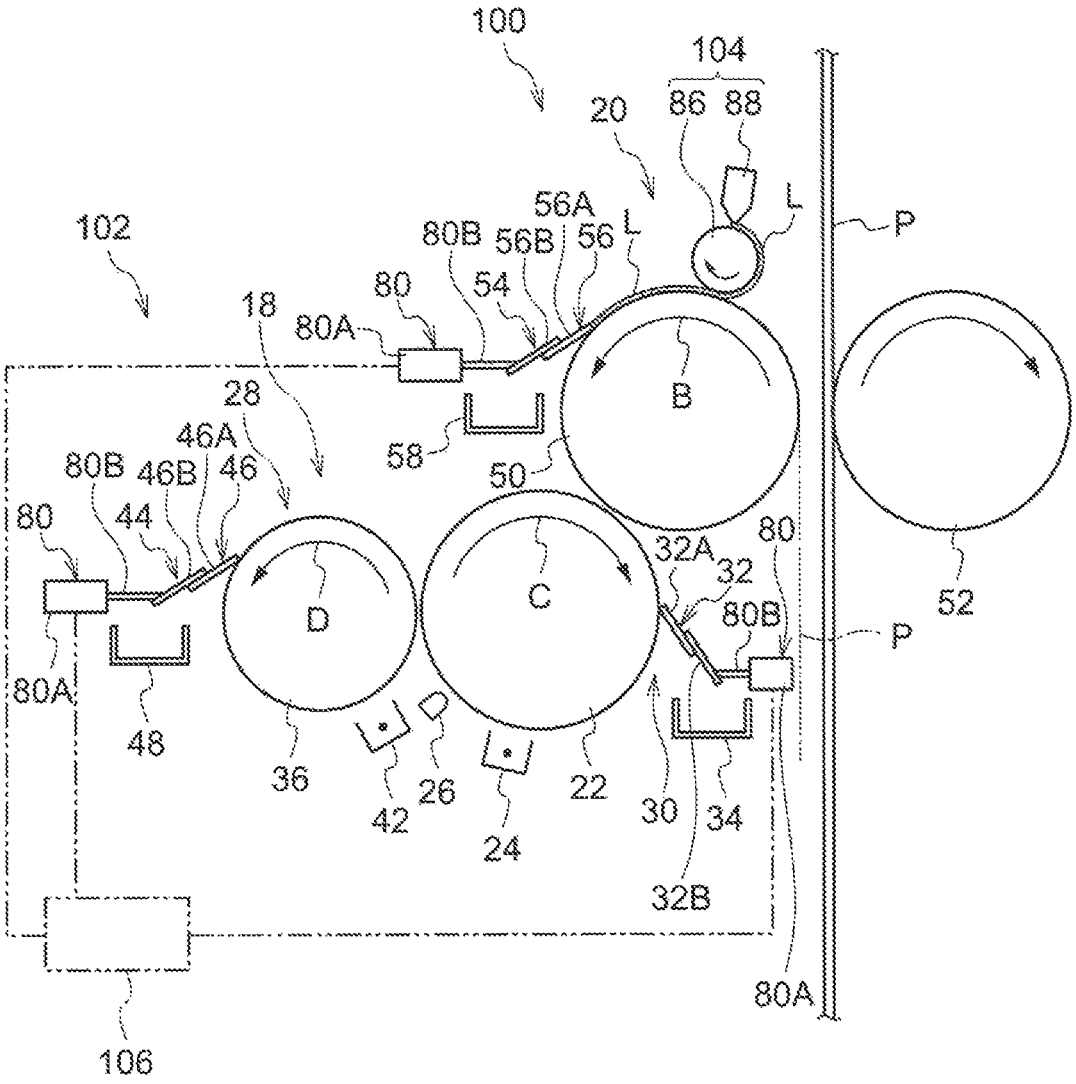
FIG. 4 is a configuration view illustrating a state in which a contact portion of a transfer roll and a cleaning member used for an image forming apparatus according to a second exemplary embodiment is washed.

As illustrated in FIG. 4, in the image forming section 102, instead of the supplying device 84 disposed in the developing roll 36 of the first exemplary embodiment, a supplying device 104 which supplies the washing liquid L to the outer peripheral surface of the transfer roll 50 as an example of the holding member is included. The supplying device 84 includes the supplying roll 86 and the nozzle 88. In the transfer roll 50, the scraping blade 56 as an example of the cleaning member is provided, the supplying device 104 is disposed at an upstream side further than the scraping blade 56 in the rotation direction (arrow B direction) of the transfer roll 50. In addition, the supplying device 104 is disposed at downstream side further than a transferring position to the continuous form paper P in the rotation direction (arrow B direction) of the transfer roll 50.

Moreover, in the exemplary embodiment, the supplying device 104 is not provided at a position facing the image holding member 22 and the developing roll 36. The image holding member 22 as an example of the other holding member is disposed to be in contact with the transfer roll 50, and the washing liquid L attached to the outer peripheral surface of the transfer roll 50 is moved (transited) to the outer peripheral surface of the image holding member 22. Further, the developing roll 36 is disposed to be in contact with the image holding member 22, and the washing liquid L attached to the outer peripheral surface of the image holding member 22 is moved (transited) to the outer peripheral surface of the developing roll 36.

The scraping blade 56 includes a plate-shaped blade portion 56A which is in contact with the transfer roll 50 and scraps the liquid developer G remained on the outer peripheral surface of the transfer roll 50, and a supporting member 56B supporting the blade portion 56A. The blade portion 56A is disposed to be in contact with the transfer roll 50 so that a front edge of the blade portion 56A is toward an upstream side of the rotation direction of the transfer roll 50. In the scraping blade 56, the contact and separation device 80 is provided as an example of a switching mechanism which allows the scraping blade 56 to be in contact with the outer peripheral surface of the transfer roll 50 or to separate the scraping blade 56 from the outer peripheral surface of the transfer roll 50.

In addition, the scraping blade 32 as an example of the other cleaning member includes a plate-shaped blade portion 32A which is in contact with the image holding member 22 and scraps the liquid developer G remained the outer peripheral surface of the image holding member 22, and a supporting member 32B supporting the blade portion 32A. The blade portion 32A is disposed to be in contact with the image holding member 22 so that a front edge of the blade portion 32A is toward an upstream side of the rotation direction of the image holding member 22. In the scraping blade 32, the contact and separation device 80 is provided as an example of a switching mechanism which allows the scraping blade 32 to be in contact with the outer peripheral surface of the image holding member 22, or to separate the scraping blade 32 from the outer peripheral surface of the image holding member 22.

In the image forming apparatus 100, a controller 106 is provided as an example of a switching mechanism which respectively controls an operation of the contact and separation device 80 of the scraping blade 56, an operation of the contact and separation device 80 of the scraping blade 32, and an operation of the contact and separation device 80 of the scraping blade 46. In addition, motors (not illustrated) are respectively connected to the image holding member 22, the developing roll 36, and the transfer roll 50, and the controller 106 controls rotational operation of the motors respectively connected to the image holding member 22, the developing roll 36, and the transfer roll 50. Moreover, the controller 106 respectively reversely rotates the image holding member 22, the developing roll 36, and the transfer roll 50 by reversely rotating the motors respectively connected to the image holding member 22, the developing roll 36, and the transfer roll 50.

Further, in the image forming apparatus 100, an evacuation device (not illustrated) is provided which evacuates the continuous form paper P and the backup roll 52 at a position separated from the transfer roll 50 in a washing process.

In a washing process, when the supplying device 104 supplies the washing liquid L to the outer peripheral surface of the transfer roll 50 which is being rotated in the arrow B direction, the washing liquid L is supplied to a contact portion between the transfer roll 50 and the scraping blade 56, and thus the contact portion between the transfer roll 50 and the scraping blade 56 is washed with the washing liquid L (refer to FIG. 4).

In addition, the controller 106 separates the scraping blade 56 from the outer peripheral surface of the transfer roll 50 by the contact and separation device 80 after washing. Accordingly, when the washing liquid L is supplied from the supplying device 104 to the outer peripheral surface of the transfer roll 50 which is being rotated, the washing liquid L is applied to the outer peripheral surface of the transfer roll 50 (refer to FIG. 5). At this time, when the image holding member 22 is rotated in the arrow C direction while being in contact with the transfer roll 50, the washing liquid L is moved (transited) from the transfer roll 50 to the image holding member 22, and the washing liquid L is supplied to the contact portion between the image holding member 22 and the scraping blade 32. Accordingly, the contact portion between the image holding member 22 and the scraping blade 32 is washed with the washing liquid L (refer to FIG. 5).

Figure 5:
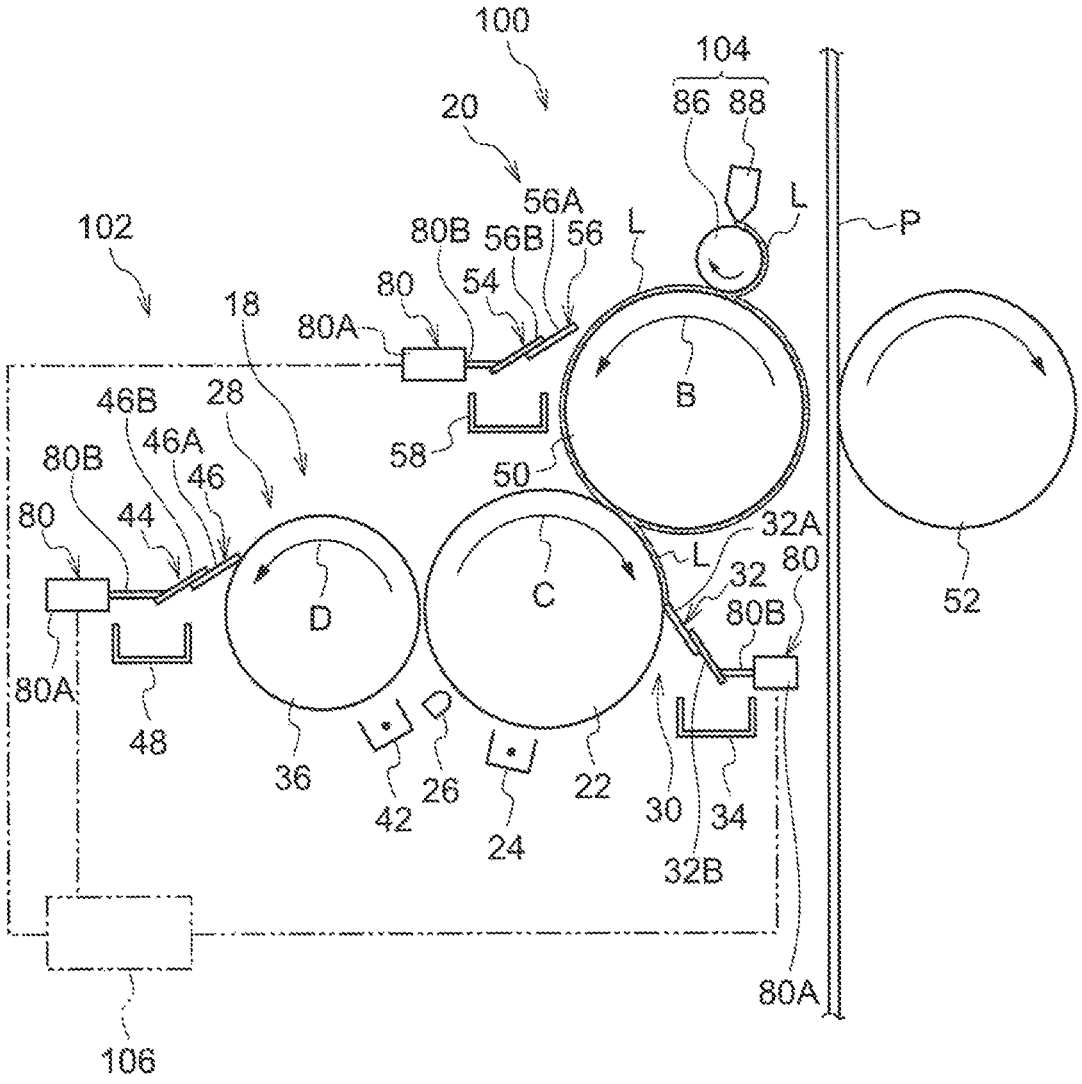
FIG. 5 is a configuration view illustrating a state in which the cleaning member is separated from the transfer roll used for the image forming apparatus illustrated in FIG. 4, the washing liquid is applied to the transfer roll, and a contact portion of the image holding member and the cleaning member is washed.

That is, as an example, the controller 106 has a function of switching the first state in which the washing liquid L is supplied to the transfer roll 50 in a state in which the scraping blade 56 is in contact with the transfer roll 50 which is being rotated after forming an image, to the second state in which the scraping blade 56 is separated from the transfer roll 50 which is being rotated and the washing liquid L is applied to the transfer roll 50 (refer to FIG. 5). In the first state, the scraping blade 56 and the contact portion between the scraping blade 56 and the transfer roll 50 are washed with the washing liquid L. In the second state, the scraping blade 32 and the contact portion between the scraping blade 32 and the image holding member 22 are washed with the washing liquid L supplied from the outer peripheral surface of the transfer roll 50 to the image holding member 22 which is being rotated (refer to FIG. 5).

Figure 6:
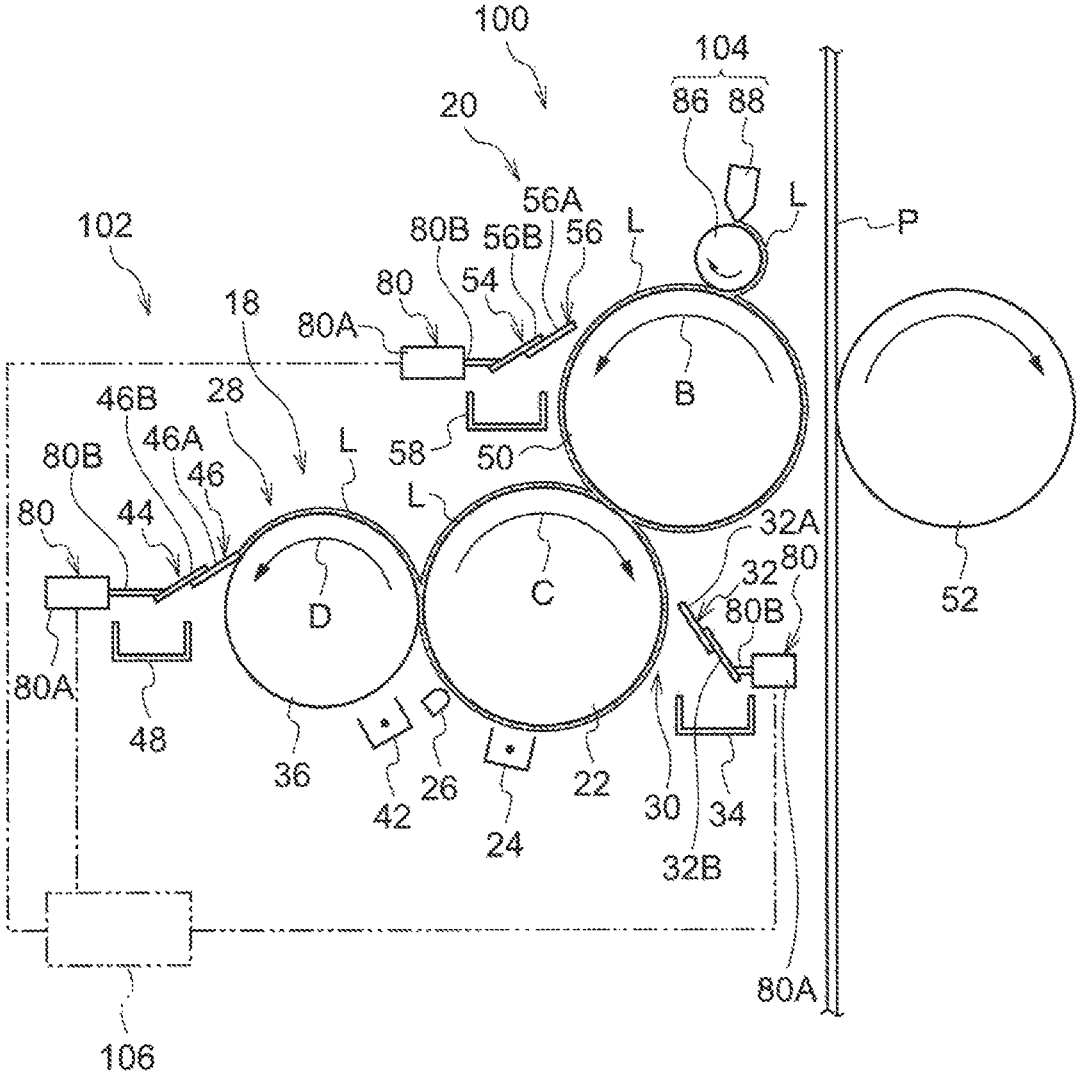
FIG. 6 is a configuration view illustrating a state in which the cleaning member is separated from the image holding member used for the image forming apparatus illustrated in FIG. 4, the washing liquid is applied to the image holding member, and a contact portion of the developing roll and the cleaning member is washed.

In addition, the controller 106 has a function of switching the second state to a third state in which the scraping blade 32 is separated from the image holding member 22 which is being rotated and the washing liquid L is applied to the image holding member 22 (refer to FIG. 6). In the third state, the scraping blade 46 and a contact portion between the scraping blade 46 and the developing roll 36 are washed with the washing liquid L supplied from the outer peripheral surface of the image holding member 22 to the developing roll 36 which is being rotated (refer to FIG. 6).

Figure 7:
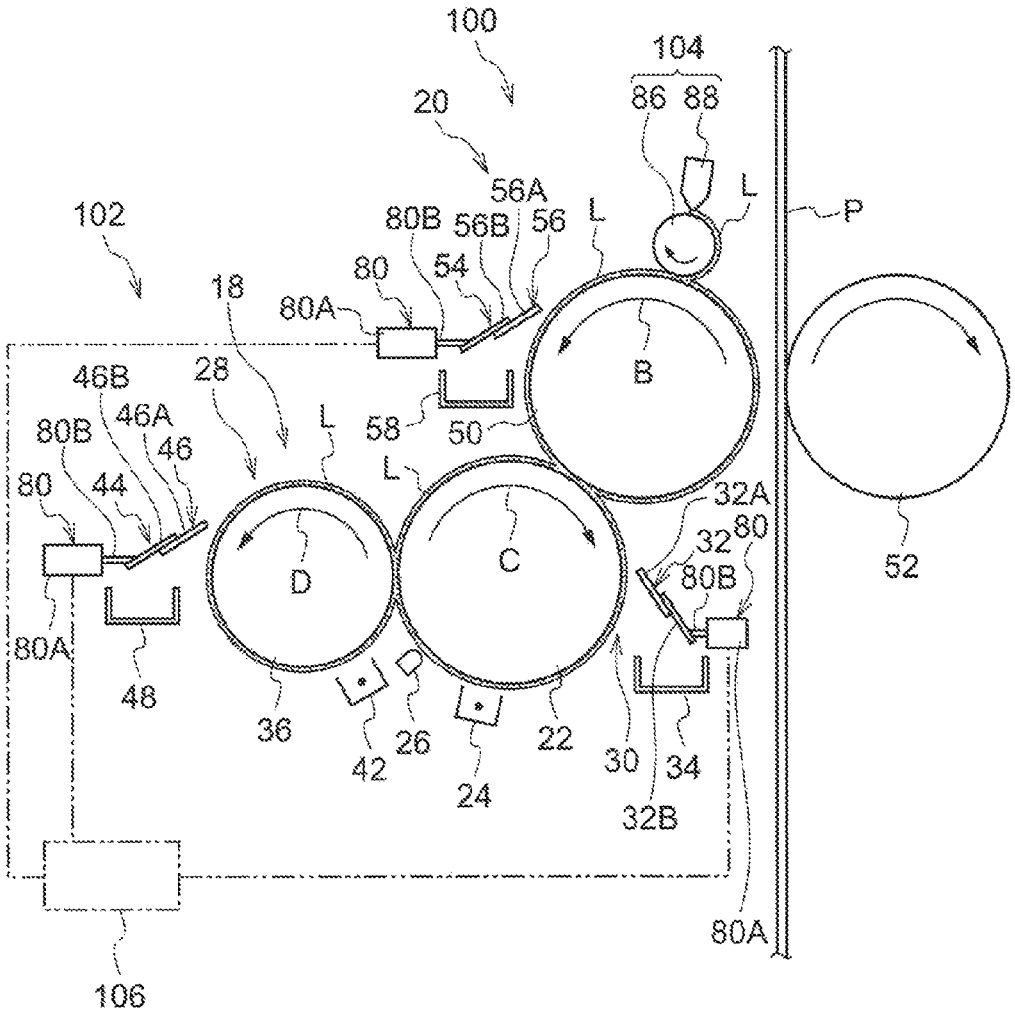
FIG. 7 is a configuration view illustrating a state in which the cleaning member is separated from the developing roll used for the image forming apparatus illustrated in FIG. 4, and the washing liquid is applied to the developing roll.

In addition, the controller 106 has a function of switching the third state to a fourth state in which the scraping blade 46 is separated from the developing roll 36 which is being rotated and the washing liquid L is applied to the developing roll 36 (refer to FIG. 7).

Further, in the image forming apparatus 100, as an example, before forming an image (for example, before starting an image forming operation such as supplying power), the controller 106 rotates the image holding member 22, the developing roll 36, and the transfer roll 50 in a state in which all of the scraping blades 32, 46, and 56 are separated from the image holding member 22, the developing roll 36, and the transfer roll 50. Accordingly, the washing liquid L is applied to the outer peripheral surfaces of the image holding member 22, the developing roll 36, and the transfer roll 50. After that, the controller 106 switches the state to a reverse rotation state in which the transfer roll 50, the image holding member 22, and the developing roll 36 are reversely rotated, in a state in which all of the scraping blades 32, 46, and 56 are respectively in contact with the image holding member 22, the developing roll 36, and the transfer roll 50. More specifically, the controller 106 rotates the transfer roll 50, the image holding member 22, and the developing roll 36 in a reverse direction (arrow F direction, arrow G direction, and arrow H direction) by reversely rotating motors (not illustrated) respectively connected to the transfer roll 50, the image holding member 22, and the developing roll 36 (refer to FIG. 8).

Action and Effect

Next, action and effect of the image forming apparatus 100 of the exemplary embodiment will be described with reference to a cleaning method of the exemplary embodiment.

As illustrated in FIG. 4, as an example, the controller 106 rotates the transfer roll 50 in the arrow B direction in a state in which the scraping blade 56 is in contact with the transfer roll 50 after forming an image (after finishing a series of image forming processes). Accordingly, the washing liquid L is supplied from the supplying device 104 to the outer peripheral surface of the transfer roll 50, and the washing liquid L is supplied to the contact portion between the transfer roll 50 and the scraping blade 56. Therefore, in the first state, the scraping blade 56 and the contact portion between the transfer roll 50 and the scraping blade 56 are washed with the washing liquid L (first process).

As illustrated in FIG. 5, after the first state, that is, as an example, after a predetermined time elapsed from starting washing in the first state, in a state in which the transfer roll 50 is rotated in the arrow B direction, the controller 106 switches the state to the second state in which the scraping blade 56 is separated from the transfer roll 50 by the contact and separation device 80. Accordingly, when the washing liquid L is supplied from the supplying device 104 to the outer peripheral surface of the transfer roll 50, the washing liquid L is applied to the outer peripheral surface of the transfer roll 50 (second process). In addition, in the second state, the image holding member 22 being in into contact with the transfer roll 50 is rotated in the arrow C direction, and the scraping blade 32 is in contact with the image holding member 22. Accordingly, when the washing liquid L is supplied from the outer peripheral surface of the transfer roll 50 to the image holding member 22 which is being rotated, the scraping blade 32 and the contact portion between the scraping blade 32 and the image holding member 22 are washed (second process).

As illustrated in FIG. 6, after the second state, that is, as an example, after a predetermined time elapsed from starting washing in the second state, in a state in which the image holding member 22 is rotated in the arrow C direction, the controller 106 switches the state to the third state in which the scraping blade 32 is separated from the image holding member 22 by the contact and separation device 80. Accordingly, when the washing liquid L is supplied from the transfer roll 50 to the outer peripheral surface of the image holding member 22, the washing liquid L is applied to the outer peripheral surface of the image holding member 22 (third process). In addition, in the third state, the developing roll 36 being in contact with the image holding member 22 is rotated in the arrow D direction, and the scraping blade 46 is in contact with the developing roll 36. Accordingly, when the washing liquid L is supplied from the outer peripheral surface of the image holding member 22 to the developing roll 36 which is being rotated, the scraping blade 46 and the contact portion between the scraping blade 46 and the developing roll 36 are washed (third process).

As illustrated in FIG. 7, after the third state, that is, as an example, after a predetermined time elapsed from starting washing in the third state, in a state in which the developing roll 36 is rotated in the arrow D direction, the controller 106 switches the state to the fourth state in which the scraping blade 46 is separated from the developing roll 36 by the contact and separation device 80. Accordingly, when the washing liquid L is supplied from the outer peripheral surface of the image holding member 22 to the outer peripheral surface of the developing roll 36, the washing liquid L is applied to the outer peripheral surface of the developing roll 36 (fourth process). In this state, rotation of the transfer roll 50, the image holding member 22, and the developing roll 36 is stopped. In other words, in a state in which the scraping blade 56, the scraping blade 32, and the scraping blade 46 are respectively separated from the transfer roll 50, the image holding member 22, and the developing roll 36, rotation of the transfer roll 50, the image holding member 22, and the developing roll 36 is stopped. Therefore, accumulation of the liquid developer G in the contact portion between the transfer roll 50 and the scraping blade 56, the contact portion between the image holding member 22 and the scraping blade 32, and the contact portion between the developing roll 36 and the scraping blade 46 are suppressed, and drying and fixing of the liquid developer G is suppressed.

In the image forming apparatus 100, as compared to a configuration in which the cleaning member comes into contact with the holding member at the time of stopping rotation of the holding member, cleaning failure or an image quality defect due to drying and fixing of the liquid developer G accumulated in the contact portion between the transfer roll 50 and the scraping blade 56 is suppressed. In addition, in the image forming apparatus 100, as compared to a configuration in which the other cleaning member at the time of stopping rotation of the other holding member comes into contact with the other holding member, cleaning failure or an image quality defect, due to drying and fixing of the liquid developer G, which is accumulated in the contact portion between the image holding member 22 and the scraping blade 32 and the contact portion between the developing roll 36 and the scraping blade 46, is suppressed.

Figure 8:
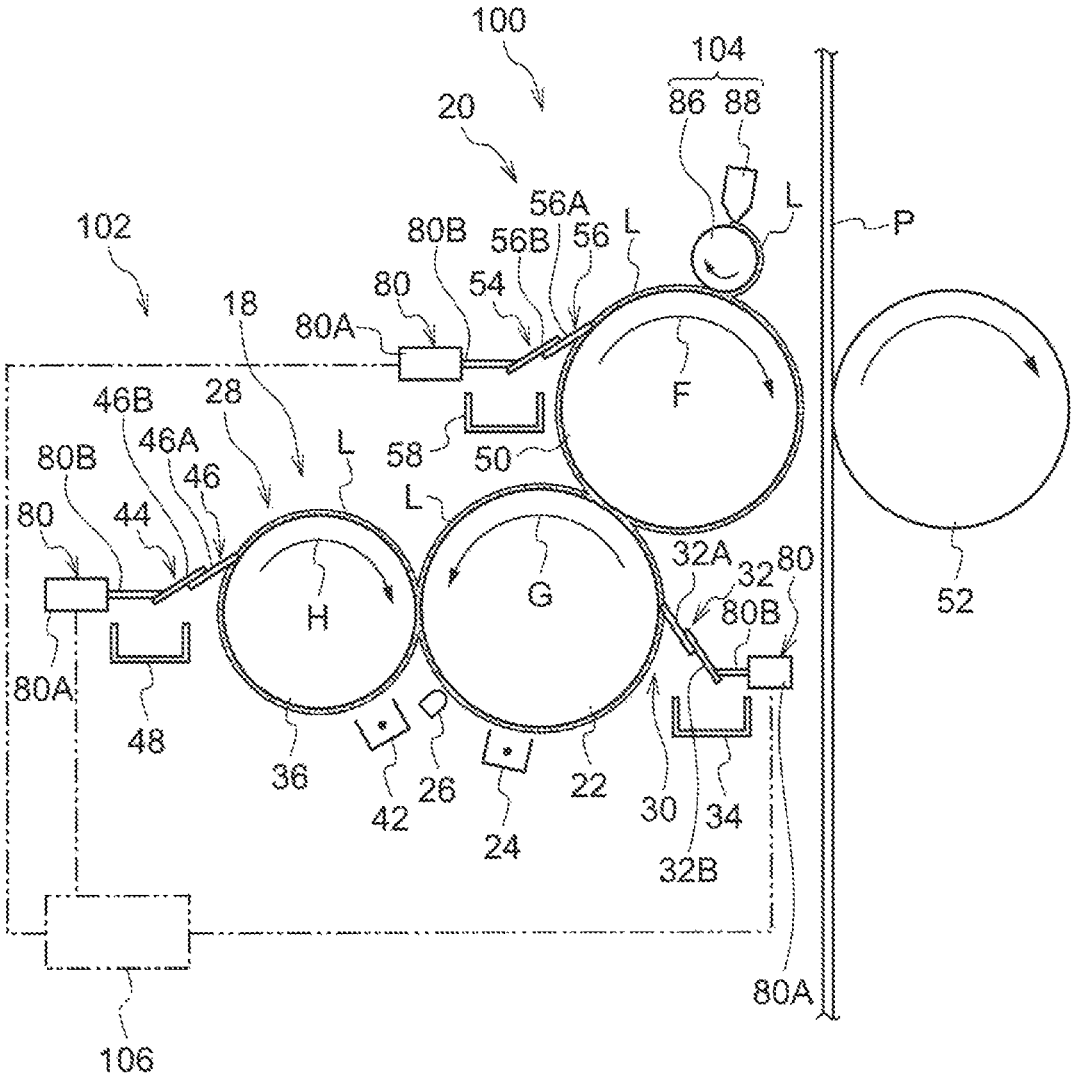
FIG. 8 is a configuration view illustrating a state in which, before forming an image, the washing liquid is applied to the transfer roll, the image holding member, and the developing roll used for the image forming apparatus illustrated in FIG. 4, and then the transfer roll, the image holding member, and the developing roll are reversely rotated.

In addition, in the image forming apparatus 100, as an example, before forming an image (for example, before starting an image forming operation such as supplying power), the controller 106 rotates the image holding member 22 in the arrow C direction, rotates the developing roll 36 in the arrow D direction, and rotates the transfer roll 50 in the arrow B direction, in a state in which all of the scraping blades 32, 46, and 56 are separated from the image holding member 22, the developing roll 36, and the transfer roll 50. Accordingly, the washing liquid L is applied to the outer peripheral surfaces of the image holding member 22, the developing roll 36, and the transfer roll 50 (refer to FIG. 7). After that, as illustrated in FIG. 8, the controller 106 reversely rotates the transfer roll 50 to the arrow F direction, reversely rotates the image holding member 22 to the arrow G direction, and reversely rotates the developing roll 36 to the arrow H direction, in a state in which all of the scraping blades 32, 46, and 56 are respectively in contact with the image holding member 22, the developing roll 36, and the transfer roll 50 (reverse rotation state). Accordingly, the image holding member 22, the developing roll 36, and the transfer roll 50 are slid to a direction where load is low with respect to the scraping blades 32, 46, and 56 (front edge direction).

In the image forming apparatus 100, as compared to a case in which the scraping blades 32, 46, and 56 are dried and brought into contact with the image holding member 22, the developing roll 36, and the transfer roll 50, damage due to friction of each member is suppressed. Further, as compared to a case in which a rotation direction of the holding member is determined (holding member is not in a reverse rotation state), unevenness generated in a thickness of the washing liquid L of the outer peripheral surface of the transfer roll 50 is suppressed. In addition, in the image forming apparatus 100, as compared to a case in which a rotation direction of the other holding member is determined (the other holding member is not in the reverse rotation state), unevenness generated in a thickness of the washing liquid L of the outer peripheral surface of the image holding member 22 and the developing roll 36 is suppressed.

Moreover, in the first exemplary embodiment and the second exemplary embodiment, the supplying device includes the supplying roll 86 and the nozzle 88; however, the invention is not limited to such a configuration, and is changeable.

In addition, in the image forming apparatus 100 of the second exemplary embodiment, in a case in which a washing liquid applying member is basically disposed on the transfer roll 50, the supplying device 104 may be used with the washing liquid applying member.

In addition, in the image forming apparatus 10 of the first exemplary embodiment, the first state in which the washing liquid L is supplied from the supplying device 84 to the developing roll 36 and the contact portion between the developing roll 36 and the scraping blade 46 is washed with the washing liquid L (refer to FIG. 2), and the second state in which the washing liquid L is applied to the outer peripheral surface of the developing roll 36 (refer to FIG. 3) are described; however, the invention is not limited thereto. For example, the washing liquid L is supplied from the developing roll 36 to the image holding member 22 and the contact portion of the image holding member 22 and the scraping blade is washed, the washing liquid L is applied to the outer peripheral surface of the image holding member 22, and the washing liquid L is supplied from the image holding member 22 to the transfer roll 50. Then, a contact portion between the transfer roll 50 and the scraping blade is washed, and the washing liquid L may be applied to the outer peripheral surface of the transfer roll 50 so as to be in a reverse direction to the image forming apparatus 100 of the second exemplary embodiment.

In addition, in the image forming apparatus 100 of the second exemplary embodiment, a state is switched in the order of the first state, the second state, the third state, and the fourth state; however, the invention is not limited to such a configuration. For example, the second state may be switched to the first state, the third state may be switched to the second state, and the fourth state may be switched to the third state.

In addition, in the first exemplary embodiment and the second exemplary embodiment, as a contact and separation device which allows the scraping blade to be brought into contact with or separated from the holding member, a cylinder is used; however, the invention is not limited thereto. For example, a contact and separation device such as a cam, an actuator, a rack and pinion may be used.

Further, in the first exemplary embodiment and the second exemplary embodiment, the plate-shaped scraping blades 32, 46, and 56 are used; however, exemplary embodiments of the invention is not limited to the plate-shaped cleaning member, and the other shape of the cleaning member may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first holding member configured to rotate and hold a liquid developer including a volatile carrier liquid;

a first cleaning member configured to come into contact with or be separated from the first holding member and clean a surface of the first holding member by being in contact with the first holding member;

a supplying device configured to supply a volatile washing liquid to the first holding member at an upstream side of the first cleaning member in a rotation direction of the first holding member, the supplying device being arranged to supply the volatile washing liquid to the first holding member at a position that is different from a position at which the liquid developer is supplied to the first holding member; and a switching mechanism configured to switch the image forming apparatus from a first state in which the washing liquid is supplied to the first holding member when the first cleaning member is in contact with the first holding member to a second state in which the first cleaning member is separated from the first holding member.

2. The image forming apparatus according to claim 1, wherein in the second state, the washing liquid is applied to the first holding member while the first cleaning member is separated from the first holding member and the first holding member is rotated.

3. The image forming apparatus according to claim 1, wherein the liquid developer includes a toner and the volatile carrier liquid, and the volatile washing liquid is substantially free of any toner.

4. The image forming apparatus according to claim 1, further comprising a container configured to accommodate the liquid developer, and wherein the liquid developer is configured to be supplied to the first holding member from the container, and the volatile washing liquid is configured to be supplied to the first holding member from a storage that is different from the container.

5. The image forming apparatus according to claim 1, further comprising a second holding member configured to rotate and come into contact with the first holding member such that the liquid developer is moved from the first holding member to the second holding member, wherein the supplying device is configured to supply the volatile washing liquid to the first holding member at a downstream side of a contact portion between the first holding member and the second holding member in a rotation direction of the first holding member.

6. The image forming apparatus according to claim 1, wherein the switching mechanism is configured to switch the image forming apparatus from the first state to the second state after the washing liquid washes a contact portion between the first cleaning member and the first holding member in the first state.

7. The image forming apparatus according to claim 1, wherein the supplying device includes a nozzle configured to supply the volatile washing liquid toward the first holding member.

8. An image forming apparatus comprising:

a first holding member configured to rotate and hold a liquid developer including a volatile carrier liquid;

a first cleaning member configured to come into contact with or be separated from the first holding member and clean a surface of the first holding member by being in contact with the first holding member;

a supplying device configured to supply a volatile washing liquid to the first holding member at an upstream side of the first cleaning member in a rotation direction of the first holding member;

a switching mechanism configured to switch the image forming apparatus from a first state in which the washing liquid is supplied to the first holding member when the first cleaning member is in contact with the first holding member and the first holding member is rotated, to a second state in which the first cleaning member is separated from the first holding member while the first holding member is rotated and the washing liquid is applied to the first holding member;

a second holding member configured to rotate and come into contact with the first holding member so that the liquid developer or the washing liquid is moved from the first holding member to the second holding member; and a second cleaning member configured to come into contact with or be separated from the second holding member and clean a surface of the second holding member by being in contact with the second holding member, wherein, in the second state, the washing liquid is supplied to the second holding member when the second cleaning member is in contact with the second holding member and the second holding member is rotated, and wherein the switching mechanism is configured to switch the second state to a third state in which the second cleaning member is separated from the second holding member while the second holding member is rotated and the washing liquid is applied to the second holding member.

9. The image forming apparatus according to claim 8, wherein the first cleaning member has a plate shape, is disposed to be in contact with the first holding member in the first state, and has a front edge that projects toward an upstream side of a rotation direction of the first holding member in the first state, and wherein the switching mechanism is configured to allow the first cleaning member to come into contact with the first holding member after applying the washing liquid to the first holding member, and to switch the first holding member to a reverse rotation state in which the first holding member is rotated in a direction reverse to the rotation direction in the first state.

10. The image forming apparatus according to claim 8, wherein the second cleaning member has a plate shape, is disposed to be in contact with the second holding member in the second state, and has a front edge that projects toward an upstream side of a rotation direction of the second holding member in the second state, and wherein the switching mechanism is configured to allow the second cleaning member to come into contact with the second holding member after applying the washing liquid to the second holding member, and to switch the second holding member to a reverse rotation state in which the second holding member is rotated in a direction reverse to the rotation direction in the second state.

11. An image forming apparatus comprising:

a first holding member configured to rotate and hold a liquid developer including a volatile carrier liquid;

a first cleaning member configured to come into contact with or be separated from the first holding member and clean a surface of the first holding member by being in contact with the first holding member;

a supplying device configured to supply a volatile washing liquid to the first holding member at an upstream side of the first cleaning member in a rotation direction of the first holding member;

a switching mechanism configured to switch the image forming apparatus from a first state in which the washing liquid is supplied to the first holding member when the first cleaning member is in contact with the first holding member and the first holding member is rotated, to a second state in which the first cleaning member is separated from the first holding member while the first holding member is rotated and the washing liquid is applied to the first holding member;

wherein the first cleaning member has a plate shape, is disposed to be in contact with the first holding member in the first state, and has a front edge that projects toward an upstream side of a rotation direction of the first holding member in the first state, and wherein the switching mechanism is configured to allow the first cleaning member to come into contact with the first holding member after applying the washing liquid to the first holding member, and to switch the first holding member to a reverse rotation state in which the first holding member is rotated in a direction reverse to the rotation direction in the first state.

12. A method of cleaning a rotatable first holding member in an image forming apparatus in which the apparatus is configured to (i) supply the first holding member with a liquid developer including a volatile carrier liquid at a first position, and (ii) supply the first holding member with a volatile washing liquid at a second position that is different from the first position, the method comprising:

washing a first cleaning member and a contact portion between the first cleaning member and the first holding member by supplying the volatile washing liquid to the first holding member at the second position when the first cleaning member is in contact with the first holding member and the first holding member is holding the liquid developer; and after the washing step, separating the first cleaning member from the first holding member, and applying the washing liquid to the first holding member at the second position and rotating the first holding member.

13. The cleaning method according to claim 12, wherein a second holding member is arranged to be in contact with the first holding member so that the liquid developer or the washing liquid including the volatile carrier liquid is moved from the first holding member to the second holding member, wherein the method further includes washing a second cleaning member and a contact portion between the second cleaning member and the second holding member with the washing liquid moved to the second holding member when the second cleaning member is in contact with the second holding member and the second holding member is rotated;

separating the second cleaning member from the second holding member; and after the step of separating the second cleaning member, applying the washing liquid to the second holding member and rotating the second holding member.

14. The cleaning method according to claim 12, further comprising:

forming an image by moving the liquid developer from the first holding member to a second holding member that is in contact with the first holding member, wherein the step of washing of the first cleaning member is performed after the forming step.

* * * * *